US008120571B2

(12) United States Patent
Ezaki et al.

(10) Patent No.: US 8,120,571 B2
(45) Date of Patent: Feb. 21, 2012

(54) LED DRIVER AND DISPLAY DEVICE USING THE SAME

(75) Inventors: Go Ezaki, Kyoto (JP); Taisuke Chida, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 994 days.

(21) Appl. No.: 12/088,969

(22) PCT Filed: Nov. 6, 2006

(86) PCT No.: PCT/JP2006/322108

§ 371 (c)(1),
(2), (4) Date: Apr. 2, 2008

(87) PCT Pub. No.: WO2007/052792

PCT Pub. Date: May 10, 2007

(65) Prior Publication Data

US 2009/0040173 A1 Feb. 12, 2009

(30) Foreign Application Priority Data

Nov. 7, 2005 (JP) ..... 2005-321748

(51) Int. Cl.
*G09G 3/36* (2006.01)

(52) U.S. Cl. ..... 345/102

(58) Field of Classification Search ..... 345/102; 315/169.1, 169.3

See application file for complete search history.

(56) References Cited

U.S. PATENT DOCUMENTS

| | | | | |
|---|---|---|---|---|
| 4,769,632 | A * | 9/1988 | Work et al. | 345/519 |
| 6,025,824 | A * | 2/2000 | Horiuchi et al. | 345/102 |
| 6,594,097 | B1 * | 7/2003 | Sako | 360/63 |
| 6,982,686 | B2 | 1/2006 | Miyachi et al. | |
| 2002/0030659 | A1 * | 3/2002 | Zavracky et al. | 345/99 |
| 2003/0169226 | A1 * | 9/2003 | Yamada | 345/102 |
| 2004/0041760 | A1 * | 3/2004 | Tsumura et al. | 345/87 |
| 2004/0114396 | A1 | 6/2004 | Kobayashi et al. | |
| 2005/0179635 | A1 * | 8/2005 | Murakami et al. | 345/100 |
| 2005/0259064 | A1 * | 11/2005 | Sugino et al. | 345/102 |
| 2006/0146005 | A1 | 7/2006 | Baba et al. | |
| 2006/0158410 | A1 | 7/2006 | Fujine | |

FOREIGN PATENT DOCUMENTS

| | | |
|---|---|---|
| EP | 1 775 711 | 4/2007 |
| JP | 49-69060 | 7/1974 |
| JP | 2001-125066 | 5/2001 |
| JP | 2002-343596 | 11/2002 |
| JP | 2003-202541 | 7/2003 |
| JP | 2004-163828 | 6/2004 |
| JP | 2004-164915 | 6/2004 |
| JP | 2004-301984 | 10/2004 |
| JP | 2005-122199 | 5/2005 |
| JP | 2005-122201 | 5/2005 |
| JP | 2006-053520 | 2/2006 |
| JP | 2006-189661 | 7/2006 |

* cited by examiner

*Primary Examiner* — Quan-Zhen Wang
*Assistant Examiner* — David Lee
(74) *Attorney, Agent, or Firm* — Fish & Richardson P.C.

(57) ABSTRACT

An LED driver 5 includes current sources (52R, 52G, 52B) for generating drive current of LED (4R, 4G, 4B); and a black insert control section (54) for generating a black insert signal (BK) for determining a black insert period in one frame from a frame synchronizing signal (such as vertical synchronizing signal VS). The current sources (52R, 52G, 52B) stop current supply to the LEDs (4R, 4G, 4B) during the black insert period according to the black insert signal (BK). With this configuration, it is possible to enhance the moving image visibility of a liquid crystal display device without increasing the load on display control means or significantly lowering the light source brightness.

6 Claims, 5 Drawing Sheets

LED DRIVER AND DISPLAY DEVICE USING THE SAME

TECHNICAL FIELD

The present invention relates to an LED driver that controls driving of an LED (light emitting diode) and a display device using the same, and more specifically relates to backlight control of a liquid crystal display device.

BACKGROUND ART

In recent years, liquid crystal display devices have been widely used not only as still-image display means (for example, display means in mobile phone terminals, digital cameras, etc.) but also as moving-image display means (for example, display means in home television sets), and there has been an increasing need for improved moving-image visibility of liquid crystal display devices, not to mention improved image quality and increased number of reproducible colors.

The key to improving the moving-image visibility of liquid crystal display devices lies in how a blurred image phenomenon (so-called afterimage phenomenon) attributable to the hold type display unique to liquid crystal display devices is alleviated.

In order to alleviate the afterimage phenomenon mentioned above, there has conventionally been employed signal processing for full screen black display performed each time an image signal of one frame is inputted (so-called black insert).

In conventional liquid crystal display devices, the black insert described above has been achieved by a full-screen black display signal inserted instead of an original image signal only during a predetermined period in one frame by use of display control means (a microcomputer or an LCD (liquid crystal display) driver) that controls driving of a liquid crystal panel (see FIGS. 6A and 6B).

As other conventional arts related to the present invention, various liquid crystal display devices have been disclosed and proposed which perform the above-described black insert not by controlling the driving of a liquid crystal panel but by performing the on-off control of a light source illuminating the liquid crystal panel (see, for example, patent publications 1 to 3).

Patent Publication 1: JP-A-2001-125066
Patent Publication 2: JP-A-2004-301984
Patent Publication 3: JP-A-2002-343596

DISCLOSURE OF THE INVENTION

Problems to be Solved by the Invention

It is true that, with the conventional liquid crystal display devices described above, it is possible to alleviate the afterimage phenomenon to improve the moving-image visibility.

However, as shown in FIGS. 6A and 6B, in the conventional liquid crystal display devices described above, the above-described black insert needs to be performed on each one of the image signals of several tens of frames per second, and this imposes a heavy load on the display control means (the microcomputer or the LCD driver). Moreover, the conventional configuration in which black insert is performed by controlling the driving of the liquid crystal panel requires an ultrafast, high-brightness liquid crystal panel, thereby inevitably leading to a cost increase.

In the liquid crystal display devices of patent publications 1 to 3, since the black insert described above can be achieved by performing the on-off control of a light source illuminating a liquid crystal panel, an ultrafast, high-brightness liquid crystal panel is not necessarily required, and thus a cost increase can be prevented.

However, in the liquid crystal display device of patent publication 1, the on-off control of the light source is performed by using part of the ability of display control means (a display control device) that should originally be dedicated to controlling the driving of the liquid crystal panel. This, as described above, imposes a heavy load on the display control device. In addition, in the liquid crystal display device of patent publication 1, since an inverter circuit is controlled in the on-off control of the light source, the response of the light source in the on-off operation is not necessarily fast, and thus the brightness of the light source may greatly deteriorate with the black insert.

Also, in the liquid crystal display device of patent publication 2, the on-off control of the light source is performed by using part of the ability of display control means (a timing controller) that should originally be dedicated to controlling the driving of the liquid crystal panel. This, as described above, imposes a heavy load on the timing controller. In addition, in the liquid crystal display device of patent publication 2, one black frame (or a plurality of black frames) is inserted every N frames. Thus, in comparison with a liquid crystal display device in which black insert is performed on each one of all the frames, the liquid crystal display device of patent publication 2 seems to be inferior in alleviating the afterimage phenomenon (and consequently in improving the moving-image visibility). Furthermore, in the liquid crystal display device of patent publication 2, as described above, since an inverter circuit is controlled in the on-off control of the light source, the response in the on-off operation is not necessarily fast, and thus the brightness of the light source may greatly deteriorate with the black insert.

In contrast, in the liquid crystal display device of patent publication 3, the on-off control of the light source is performed according to a vertical synchronizing signal separated from an image signal, and thus the load on display control means (a liquid crystal panel control circuit) is not unnecessarily increased. However, also in the liquid crystal display device of patent publication 3, as described above, since an inverter is controlled in the on-off control of the light source, the response in the on-off operation is not necessarily fast, and thus the brightness of the light source may greatly deteriorate with the black insert.

In view of the problems described above, the present invention has been made, and an object of the invention is to provide an LED driver capable of enhancing the moving-image visibility of a display device without imposing a heavier load on display control means (a microcomputer or an LCD driver) or greatly deteriorating the brightness of a light source, and a display device using the same.

Means for Solving the Problem

To achieve the above object, according to one aspect of the present invention, an LED driver performing on-off control of an LED illuminating a display panel includes: a current source generating a drive current of the LED; and a black insert control section generating, from a frame synchronizing signal for synchronizing a screen display process in the display panel, a black insert signal for determining a black insert period in one frame. Here, the current source, according to the black insert signal, stops supplying the drive current to the LED only during the black insert period (first configuration).

According to the present invention, it is preferable that, in the LED driver having the first configuration described above, the current source include: an operational amplifier comparing a voltage applied to a first input terminal with a reference voltage applied to a second input terminal; a first transistor supplying a first current to the LED according to a result of comparison by the operational amplifier; a second transistor outputting a second current according to the result of the comparison by the operational amplifier; a first resistor generating a first feedback voltage whose voltage level varies according to the first current; a second resistor generating a second feedback voltage whose voltage level varies according to the second current; a first switch switching, according to the black insert signal, between feeding the result of the comparison by the operational amplifier to the first transistor and feeding a predetermined voltage to the first transistor to turn the first transistor off; a second switch switching, according to the black insert signal, between feeding the result of the comparison by the operational amplifier to the second transistor and feeding a predetermined voltage to the second transistor to turn the second transistor off; and a third switch switching, according to the black insert signal, between feeding the first feedback voltage to the first input terminal of the operational amplifier and feeding the second feedback voltage to the first input terminal of the operational amplifier (second configuration).

According to the present invention, it is preferable that, in the LED driver having the first or the second configuration described above, the black insert control section include: a delay circuit providing a delay equivalent to the black insert period with respect to a vertical synchronizing signal, as the frame synchronizing signal, for achieving synchronization in a frame vertical direction; and an SR flip-flop receiving, as input triggers, the vertical synchronizing signal and an output signal of the delay circuit, and the black insert control section output an output signal of the SR flip-flop as the black insert signal (third configuration).

According to the present invention, in the LED driver having the third configuration described above, it is preferable that the black insert control section include a logical operation circuit that, according to an enable signal for controlling whether or not to permit black insert, directly passes the output signal of the SR flip-flop when the black insert is permitted, and when the black insert is inhibited, masks the output signal of the SR flip-flop (fourth configuration).

According to the present invention, it is preferable that the LED driver having the second configuration described above further include a current control section that generates a voltage signal whose voltage level varies according to a current-amount control signal for setting an amount of the drive current, and supplies the voltage signal as the reference voltage to the current source (fifth configuration).

According to the present invention, it is preferable that, in the LED driver having the fifth configuration described above, the current control section set, according to an enable signal for controlling whether or not to permit black insert, the voltage level of the voltage signal such that the voltage level of the voltage signal generated is higher when the black insert is permitted than it is when the black insert is inhibited (sixth configuration).

According to another aspect of the present invention, an LED driver performing on-off control of an LED illuminating a display panel includes: a current source generating a drive current of the LED; a black insert control section generating, from a frame synchronizing signal for synchronizing a screen display process in the display panel, a black insert signal for determining a black insert period in one frame; and a switch cutting off the drive current to the LED only during the black insert period according to the black insert signal (seventh configuration).

According to another aspect of the present invention, a display device includes a display panel, an LED illuminating the display panel, and the LED driver having any one of the first to seventh configurations performing on-off control of the LED (eighth configuration).

Advantages of the Invention

According to the present invention, it is possible to provide an LED driver with which the moving-image visibility of a display device can be enhanced without imposing a heavier load on display control means (a microcomputer or an LCD driver) or without greatly deteriorating the brightness of a light source, and a display device using the same.

LIST OF REFERENCE SYMBOLS

Figure 1:
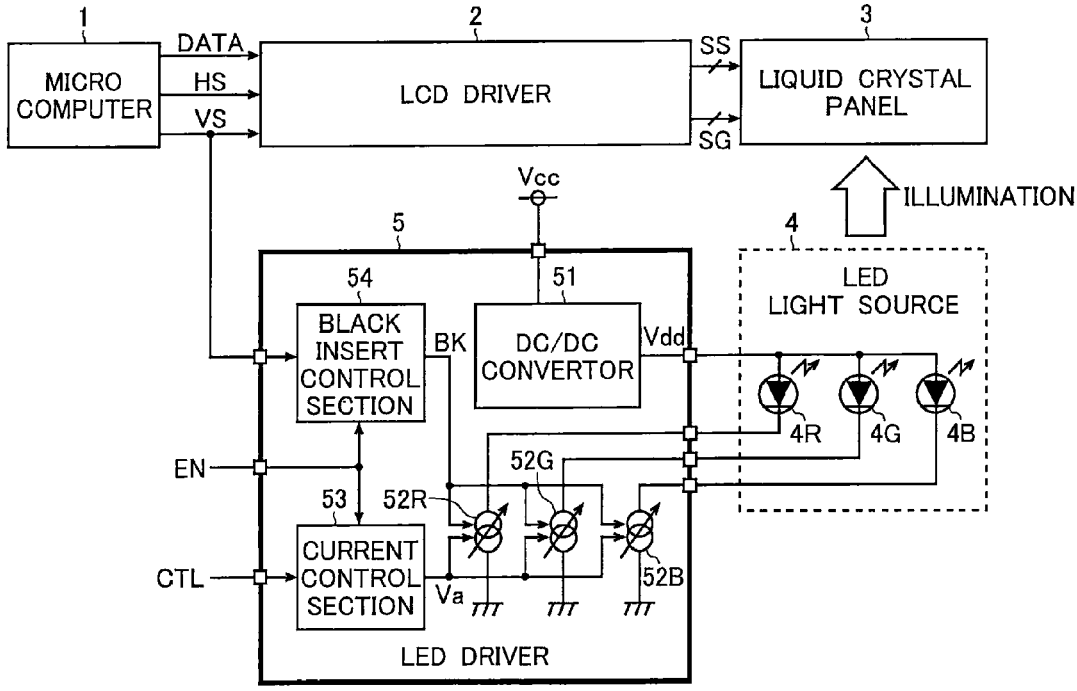
FIG. 1 is a block diagram showing an embodiment of a liquid crystal display device incorporating an LED driver of the present invention.

1 microcomputer
2 LCD driver
3 liquid crystal panel
4 LED light source (backlight)
5 LED driver
4R, 4G, 4B red LED, green LED, blue LED
51 DC/DC converter
52R, 52G, 52B variable current sources
53 current control section (DAC)
54 black insert control section
541 delay circuit
542 SR flip-flop
543 AND circuit
55R, 55G, 55B constant current sources
56R, 56G, 56B switches
M1, M2 N-channel-type field effect transistors
Q1, Q2 npn-type bipolar transistors
R1, R2 resistors
SW1-SW3 switches
OP1 operational amplifier

BEST MODE FOR CARRYING OUT THE INVENTION

FIG. 1 is a block diagram showing an embodiment of a liquid crystal display device incorporating an LED driver of the present invention (in particular, a liquid crystal display device used in apparatuses, such as television sets and portable game machines, mainly as means adapted to display moving images).

As shown in the figure, the liquid crystal display device of this embodiment includes a microcomputer 1, an LCD driver 2, a liquid crystal panel 3, an LED driver 5, and an LED light source 4.

The microcomputer 1 functions as means adapted to integrally control the entire device. The microcomputer 1 also functions as means adapted to, on receiving an image signal from media reproduction apparatus (unillustrated) or other apparatuses, separate and generate a data signal DATA for driving each of RGB pixels provided on the liquid crystal panel 3 and frame synchronizing signals for synchronizing a screen display process in the liquid crystal panel 3 (a horizontal synchronizing signal HS for achieving synchronization in the frame horizontal direction, and a vertical synchronizing signal VS for achieving synchronization in the frame vertical direction).

The LCD driver 2 includes a source control section and a gate control section (both unillustrated). The LCD driver 2 is means adapted to generate a source signal and a gate signal of the liquid crystal panel 3 based on the data signal DATA and the frame synchronizing signals (the horizontal synchronizing signal HS and the vertical synchronizing signal VS) from the microcomputer 1, and supply the source signal and the gate signal to the liquid crystal panel 3.

The liquid crystal panel 3 (as an active matrix type) has a plurality of source signal lines and a plurality of gate signal lines laid in a vertical direction and in a horizontal direction, respectively, has liquid crystal pixels provided one at each of the intersections of the source and gate signal lines, and drives the liquid crystal pixels according to the on-off state of their respective corresponding active devices (field effect transistors).

The configurations of the LCD driver 2 and the liquid crystal panel 3 are not limited to those described above, and a simple matrix type may be used.

The LED light source 4 is backlight means adapted to illuminate the liquid crystal panel 3 from behind. The LED light source 4 of this embodiment includes an LED 4R emitting red light, an LED 4G emitting green light, and an LED 4B emitting blue light. The LED light source 4 generates white light by simultaneously lighting all the LEDs 4R, 4G, and 4B or by lighting them in turn at predetermined intervals as the backlight of an FS (field sequential) type. Although not shown in the figure, between the liquid crystal panel 3 and the LED light source 4, there is provided light guide means adapted to uniformly illuminate the whole surface of the liquid crystal panel 3 with the white light generated by the LED light source 4.

The LED driver 5 is means adapted to control light emission operation of the LEDs 4R, 4G, and 4B, thereby adjusting the brightness and the white balance of the LED light source 4. The LED driver 5 of this embodiment includes a DC/DC converter 51, variable current sources 52R, 52G, and 52B, a current control section 53, and a black insert control section 54.

The DC/DC converter 51 is DC/DC converter means adapted to generate a drive voltage Vdd of the LED light source 4 from a power source voltage Vcc, and is built with a switching regulator or a charge pump.

The variable current sources 52R, 52G, and 52B are means adapted to generate drive currents of the LEDs 4R, 4G, and 4B, respectively, according to a reference voltage (current amount setting voltage) Va and a black insert signal BK, which will both be described later. More specifically, the variable current sources 52R, 520, and 52B, according to the black insert signal BK, stop supplying drive currents to the LEDs 4R, 4G, and 4B only during a predetermined black insert period "d", that is, full-screen black display is performed by completely turning off the LED light source 4. A detailed description will be given later with respect to the configurations and the operation of the variable current sources 52R, 52G, and 52B.

The current control section 53 is means adapted to generate a voltage signal whose voltage level varies according to a current amount control signal CTL for setting the amount of drive current to be supplied to the LEDs 4R, 4G, and 4B, and supply the voltage signal as the above described reference voltage Va to the variable current sources 52R, 52G, and 52B. With this configuration provided with such the current control section 53 described above, it is possible to adjust the brightness of the liquid crystal panel 3 and the white balance of the LED light source 4 according to the current amount control signal CTL. In a case where a digital signal is inputted as the above-described current amount control signal CTL, it is preferable to provide as the current control section 53, D/A (digital/analog) converter means adapted to generate the reference voltage Va by converting the digital signal into an analog signal.

The black insert control section 54 is means adapted to generate, from the frame synchronizing signals (in particular, the vertical synchronizing signal VS) for synchronizing a screen display process in the liquid crystal panel 3, the black insert signal BK for setting the black insert period "d" in one frame. A detailed description will be given later with respect to the configuration and operation of the black insert control section 54.

As described above, the LED driver 5 of this embodiment includes the variable current sources 52R, 52G, and 52B that generate the drive currents of the LEDs 4R, 4G, and 4B, and the black insert control section 54 that generates, from the frame synchronizing signals (in this embodiment, the vertical synchronizing signal VS), the black insert signal BK for determining the black insert period "d" in one frame. The variable current sources 52R, 52G, and 52B, according to the black insert signal BK, stop supplying drive currents to the LEDs 4R, 4G, and 4B only during the predetermined black insert period "d".

With the LED driver 5 configured as described above and a liquid crystal display device incorporating the same, it is possible to enhance the moving-image visibility of the liquid crystal display device without increasing the load on display control means (a microcomputer 1 or an LCD driver 2). In addition, an ultrafast, high-brightness liquid crystal panel 3 is not necessarily required, and thus a cost increase can be prevented.

Moreover, in contrast to a conventional LED driver in which an inverter circuit is controlled in the on-off control of the light source, the LED driver 5 of this embodiment controls whether or not to permit supply of the driving current to the LED light source 4. Thus, with the LED driver 5 of this embodiment, it is possible to improve the response in the on-off operation, and thereby prevent deterioration in the brightness of the LED light source 4 accompanying the black insert.

Next, a detailed description will be given with respect to the configuration and the operation of the black insert control section 54, with reference to FIGS. 2A and 2B.

Figure 2A:
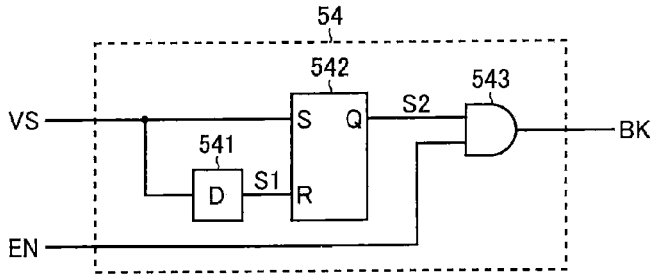
FIG. 2A is a block diagram showing an example of the configuration of a black insert control section 54.
Figure 2B:
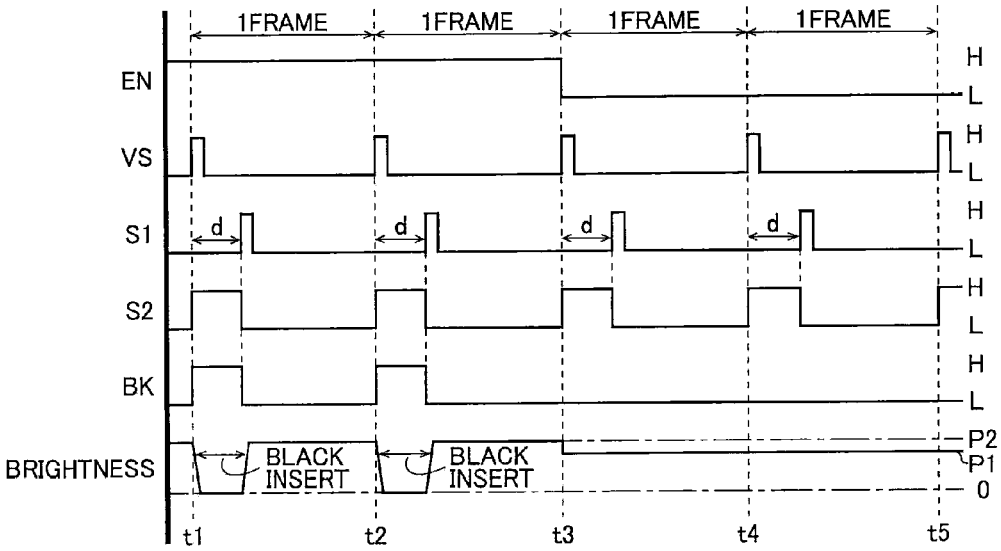
FIG. 2B is a timing chart showing how the black insert control section 54 operates.

FIG. 2A is a block diagram showing an example of the configuration of the black insert control section 54, and FIG. 2B is a timing chart showing how the black insert control section 54 operates.

As shown in FIG. 2A, the black insert control section 54 includes a delay circuit 541, an SR flip-flop 542, and an AND circuit 543.

An input terminal of the delay circuit 541 and a set input terminal (S) of the SR flip-flop 542 are both connected to a terminal to which the vertical synchronizing signal VS is applied. A reset input terminal (R) of the SR flip-flop 542 is connected to an output terminal of the delay circuit 541. An output terminal (Q) of the SR flip-flop 542 is connected to one input terminal of the AND circuit 543. The other input terminal of the AND circuit 543 is connected to a terminal to which an enable signal EN is applied. The output terminal of the AND circuit 543 is connected, as a terminal from which the black insert signal BK is extracted, to black insert control terminals of the variable current sources 52R, 52G, and 52B.

The enable signal EN described above is a logic signal for controlling whether or not to permit black insert. When black insert is permitted, the logic level of the enable signal EN is kept "H (high level)". When black insert is inhibited, the logic level of the enable signal EN is kept "L (low level)".

A detailed description will be given with respect to the operation of the black insert control section 54 configured as described above, with reference to FIG. 2B.

At times t1 to t5, a pulse indicating the start of one frame (conversely, a pulse indicating the end of a previous frame) rises in the vertical synchronizing signal VS. Accordingly, an output signal S2 of the SR flip-flop 542 is turned to "H (high level)" with a rising edge of the vertical synchronizing signal Vs used as a set trigger.

Meanwhile, in the delay circuit 541, a delay equivalent to the black insert period "d" (for example, 5 ms) with respect to the vertical synchronizing signal VS described above is provided to thereby generate a delay signal S1. Accordingly, an output signal S2 of the SR flip-flop 542 is turned back to "L (low level)" with a rising edge of the delay signal S1 used as a set trigger.

That is, the logic level of the output signal S2 is "H (high level)" only during the black insert period "d", and is otherwise "L (low level)". While the enable signal EN is kept "H (high level)", the output signal S2 is fed to the variable current sources 52R, 52G, and 52B as the black insert signal BK.

In this way, with the black insert control section 54 of this embodiment, it is possible, with an extremely simple configuration, to generate, from the vertical synchronizing signal VS, the black insert signal BK for determining the black insert period "d" in one frame.

Furthermore, in the AND circuit 543 in the black insert control section 54 of this embodiment, an AND operation between the output signal S2 of the SR flip-flop 542 and the enable signal EN is performed and the operation result is outputted as the black insert signal BK. That is, the AND circuit 543 functions as means adapted to, according to the enable signal EN, directly pass the output signal S2 when black insert is permitted (while the enable signal EN is at a high level, i.e., from time t1 to time t3 in the figure) and mask the output signal S2 when black insert is inhibited (while the enable signal EN is at a low level, i.e., from time t3 to time t5 in the figure).

Such a configuration allows the user to choose whether or not to permit black insert as he/she desires.

Moreover, in the LED driver 5 of this embodiment, the current control section 53, according to the enable signal EN, sets the voltage level of the voltage signal (and consequently the reference voltage Va) that it generates such that a larger amount of drive current is supplied to the LED light source 4 when black insert is permitted (from time t1 to time t3) than when black insert is inhibited (from time t3 to time t5).

More specifically, according to this embodiment, the current control section 53 sets the voltage level of the voltage signal (and consequently the reference voltage Va) it generates higher when black insert is permitted than when black insert is inhibited.

With such a configuration, the brightness P2 of the LED light source 4 when black insert is permitted is enhanced compared with the brightness P1 of the LED light source 4 when black insert is inhibited, and thus it is possible to compensate for the deterioration in the brightness of the LED light source 4 accompanying the black insert.

The circuit configuration of the black insert control section 54 is not limited to the configuration described above, but any other circuit configuration may be adopted as long as it achieves equivalent operation.

Next, a detailed description will be given with respect to the configurations and the operation of the variable current sources 52R, 52G, and 52B, with reference to FIG. 3.

Figure 3:
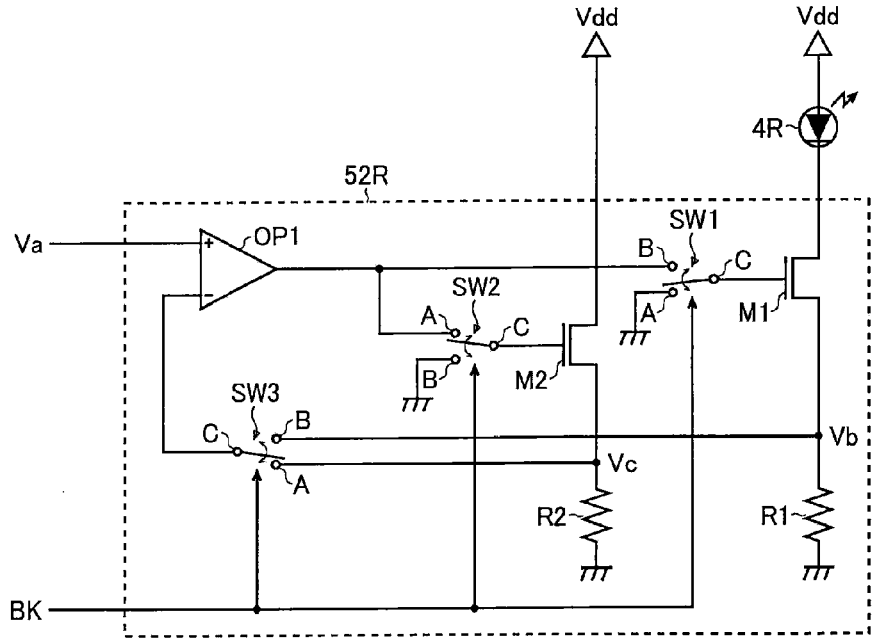
FIG. 3 is a block diagram showing an example of the configuration of a variable current source 52R.

FIG. 3 is a block diagram showing an example of the configuration of the variable current source 52R (partially including circuit elements). Since the variable current sources 52R, 52G, and 52B have the same configuration, a detailed description will be given only with respect to the configuration of the variable current source 52R as their representative, while omitting descriptions of the variable current sources 52G and 52B.

As shown in the figure, the variable current source 52R of this embodiment includes N-channel-type field effect transistors M1 and M2, resistors R1 and R2, switches SW1 to SW3, and an operational amplifier OP1.

The gate of the transistor M1 is connected to a terminal C of the switch SW1. The drain of the transistor M1 is connected to the cathode of the LED 4R. The source of the transistor M1 is grounded via the resistor R1, and is also connected to a terminal B of the switch SW3.

The gate of the transistor M2 is connected to a terminal C of the switch SW2. The drain of the transistor M2 is connected to a terminal to which the drive voltage Vdd is applied (an output terminal of the DC/DC converter 51). The source of the transistor M2 is grounded via the resistor R2, and is also connected to a terminal A of the switch SW3.

The non-inverting input terminal (+) of the operational amplifier OP1 is connected to a terminal to which the reference voltage Va is applied (an output terminal of the current control section 53). The inverting input terminal (−) of the operational amplifier OP1 is connected to a terminal C of the switch SW3. The output terminal of the operational amplifier OP1 is connected to a terminal B of the switch SW1 and a terminal A of the switch SW2.

A terminal A of the switch SW1 and a terminal B of the switch SW2 are both grounded. The control terminals of the switches SW1 to SW3 are connected to a terminal to which the black insert signal BK is applied.

The resistor R1 is a resistor for converting the drain current of the transistor M1 into a feedback voltage Vb (a voltage signal whose voltage level varies according to the drain current of the transistor M1).

The resistor R2 is a resistor for converting the drain current of the transistor M2 into a feedback voltage Vc (a voltage signal whose voltage level varies according to the drain current of the transistor M2).

The operational amplifier OP1 compares the reference voltage Va with one of the feedback voltages Vb and Vc, and generates a comparison voltage that represents the comparison result. The thus-generated comparison voltage is fed to the gate of the transistor M1 via the switch SW1 or to the gate of the transistor M2 via the switch SW2.

The transistor M1 outputs a drain current according to the comparison voltage fed from the operational amplifier OP1 via the switch SW1, and supplies the drain current to the LED 4R. The drain current is also supplied to the resistor R1.

The transistor M2 outputs a drain current according to the comparison voltage fed from the operational amplifier OP1 via the switch SW2. The drain current is supplied to the resistor R2.

According to the black insert signal BK, the switch SW1 performs switching between feeding the comparison voltage fed from the operational amplifier OP1 to the gate of the transistor M1 and feeding a ground voltage to the gate of the transistor M1.

According to the black insert signal BK, the switch SW2 performs switching between feeding a ground voltage to the gate of the transistor M2 and feeding the comparison voltage fed from the operational amplifier OP1 to the gate of the transistor M2.

According to the black insert signal BK, the switch SW3 performs switching between feeding the feedback voltage Vb to the inverting input terminal (−) of the operational amplifier OP1 and feeding the feedback voltage Vc to the inverting input terminal (−) of the operational amplifier OP1.

Next, a description will be given with respect to the operation of the variable current source 52R configured as described above.

When the logic level of the black insert signal BK is "L (low level)", each of the switches SW1 to SW3 connects together the terminals B and C.

In this state, the comparison voltage outputted from the operational amplifier OP1 is fed to the gate of the transistor M1, and the transistor M1 supplies a drain current corresponding to the comparison voltage to the LED 4R. As a result, the LED 4R is lit. The feedback voltage Vb generated at the resistor R1 by the drain current of the transistor M1 is fed to the inverting input terminal (−) of the operational amplifier OP1. Since a negative feedback circuit is formed between the operational amplifier OP1 and the transistor M1 in this way, the feedback voltage Vb applied to the inverting input terminal of the operational amplifier OP1 converges to the reference voltage Va. Thus, the transistor M1 can feed the LED 4R with a predetermined drain current corresponding to the reference voltage Va.

As described above, in the variable current source 52R of this embodiment, the negative feedback circuit is formed between the operational amplifier OP1 and the transistor M1 when the LED 4R is lit, and thus, even if a forward-drop voltage of the LED 4R and the properties of the transistor M1 vary due to the ambient temperature or other factors, it is possible to make the feedback voltage Vb converge to the reference voltage Va without fail and thus to prevent a variation in the amount of current fed to the LED 4R.

On the other hand, when the logic level of the black insert signal BK is "H (high level)", each of the switches SW1 to SW3 connect together the terminals A and C.

In this state, a ground voltage is fed to the gate of the transistor M1, and the transistor M1 is turned off. As a result, the LED 4R is not lit (black insert state).

In this state, the comparison voltage outputted from the operational amplifier OP1 is fed to the gate of the transistor M2, and the transistor M2 outputs a drain current corresponding to the comparison voltage. The feedback voltage Vc generated at the resistor R2 by the drain current of the transistor M2 is fed to the inverting input terminal (−) of the operational amplifier OP1. Since a negative feedback circuit is formed between the operational amplifier OP1 and the transistor M2 in this way, the feedback voltage Vc applied to the inverting input terminal of the operational amplifier OP1 converges to the reference voltage Va, as in the case where the LED 4R is lit.

As described above, in the variable current source 52R of this embodiment, the negative feedback circuit is formed between the operational amplifier OP1 and the transistor M2 even when the LED 4R is not lit, and the voltage applied to the inverting input terminal of the operational amplifier OP1 is made to converge to the reference voltage Va. Thus, it is possible to prevent the operating point of the operational amplifier OP1 when the LED 4R is not lit from being greatly apart from the operating point of the operational amplifier OP1 when the LED 4R is lit.

Accordingly, the variable current source 52R of this embodiment can supply a predetermined current to the LED 4R in a short period to light the LED 4R from an unlit state. Therefore, with the variable current source 52R of this embodiment, it is possible to enhance the response in the on-off operation, and thus to prevent deterioration in the brightness of the LED light source 4 accompanying the black insert.

The resistance of the resistor R2 can be made larger than that of the resistor R1. With such a configuration, the value of the drain current of the transistor M2, which does not need to be particularly large, can be made small, whereby the power consumption of the variable current source 52R can be reduced. For example, when the resistance value of the resistor R1 is set at 1 Ω and that of the resistor R2 is set at 2.5 Ω, the drain current of the transistor M2 can be reduced to 1/250 of the drain current of the transistor M1.

It is preferable that the feedback voltage Vb of the transistor M1 when the LED is lit and the feedback voltage Vc of the transistor M2 when the LED is not lit both converge to the reference voltage Va of each LED, but this does not necessarily limit the present invention. For example, it seems that the object of the present invention can be achieved when the absolute difference between the feedback voltages Vb and Vc is 0.2 V or less. Therefore, as long as this condition is satisfied, the transistor M2 and the resistor R2 can be shared by more than one LED.

The present invention may be carried out in any manner other than specifically described above as embodiments, and permits any variations and modifications within the spirit thereof.

Figure 4:
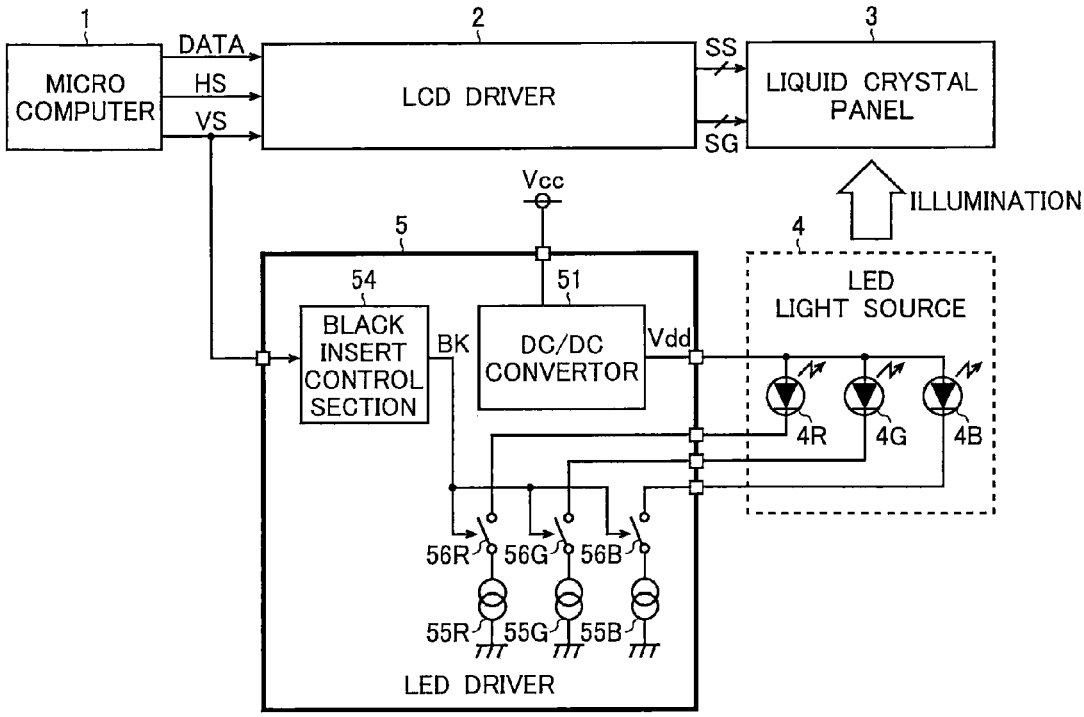
FIG. 4 is a block diagram showing a modified example of the LED driver 5.

The above description deals with, as an example, the LED driver 5 shown in FIG. 1 in which the variable current sources 52R, 52G, and 52B are provided as means adapted to supply drive currents to the LED light source 4 and the variable current sources each function also as a switch for complete turning off in black insert. However, this does not limit the present invention, and for example, as shown in FIG. 4, the current sources 55R, 55G, and 55B may be provided as means adapted to supply drive currents to the LED light source 4, and switches 56R, 56G, and 56B for complete turning off in black insert (i.e., switches for, according to the black insert signal BK, cutting off the drive currents supplied to the LEDs 4R, 4G, and 4B only during the black insert period "d") may be separately provided.

Figure 5:
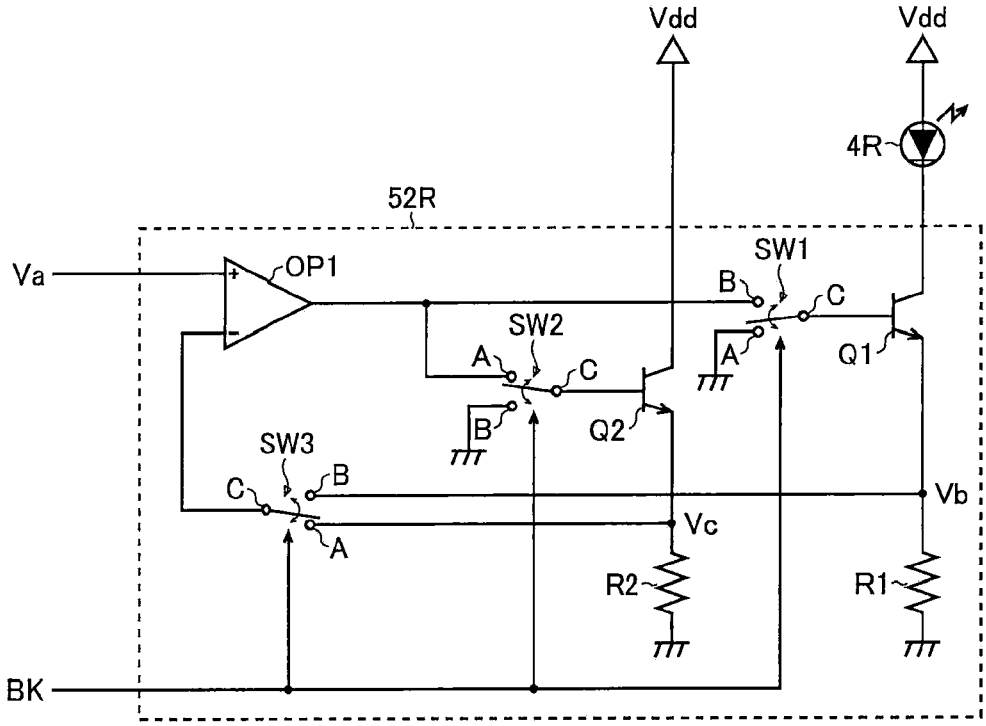
FIG. 5 is a block diagram showing a modified example of the variable current source 52R.
Figure 6A:
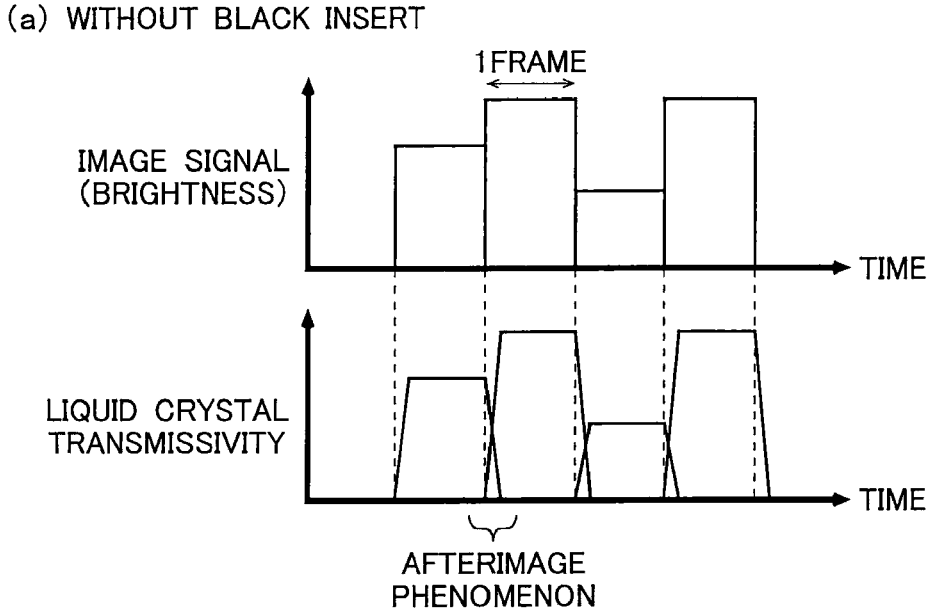
FIG. 6A is a diagram for illustrating conventional black insert (without black insert being performed).
Figure 6B:
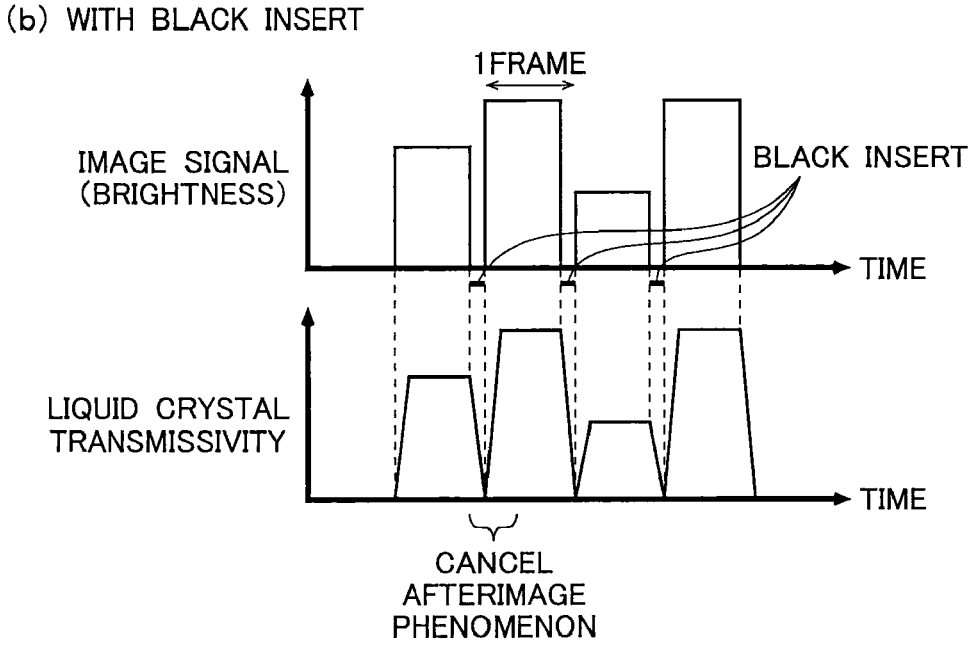
FIG. 6B is a diagram for illustrating the conventional black insert (with black insert performed).

Furthermore, the above description deals with, as an example, the variable current source 52R shown in FIG. 3 in which the N-channel type field effect transistors M1 and M2 are used. However, this does not limit the present invention, and as shown in FIG. 5, npn-type bipolar transistors Q1 and Q2 may be used instead of the N-channel type field effect transistors M1 and M2

Also, the above description only deals with, as an example, the case where LEDs of the three colors R, G, and B are used. In addition to this case, the present invention can be applied in cases where LEDs of other color combinations are used and where a white LED is used.

INDUSTRIAL APPLICABILITY

The present invention offers a technology useful for improving the moving image visibility of a liquid crystal display device used mainly as moving-image display means used in apparatuses such as television sets and portable game machines.

what is claimed is:

1. An LED driver for performing on-off control of LEDs illuminating a display panel, the LED driver comprising:

current sources each of which generates a drive current of a corresponding one of the LEDs; and a black insert control section to generate, from a frame synchronizing signal for synchronizing a screen display process in the display panel, a black insert signal for determining a black insert period in one frame, wherein each of the current sources, in accordance with the black insert signal, stops supplying the drive current to the corresponding one of the LEDs only during the black insert period;

wherein each of the current sources comprises:

an operational amplifier to compare a voltage applied to a first input terminal with a reference voltage applied to a second input terminal;

a first transistor to supply a first current to the corresponding one of the LEDs according to a result of comparison by the operational amplifier;

a second transistor to output a second current according to the result of the comparison by the operational amplifier;

a first resistor to generate a first feedback voltage whose voltage level varies according to the first current;

a second resistor to generate a second feedback voltage whose voltage level varies according to the second current;

a first switch to switch, according to the black insert signal, between feeding the result of the comparison by the operational amplifier to the first transistor and feeding a predetermined voltage to the first transistor to turn the first transistor off;

a second switch to switch, according to the black insert signal, between feeding the result of the comparison by the operational amplifier to the second transistor and feeding a predetermined voltage to the second transistor to turn the second transistor off; and a third switch to switch, according to the black insert signal, between feeding the first feedback voltage to the first input terminal of the operational amplifier and feeding the second feedback voltage to the first input terminal of the operational amplifier, wherein at least two of the current sources share a single transistor as the second transistor, and the current sources share a single resistor as the second resistor.

2. The LED driver of claim 1, wherein the black insert control section comprises:

a delay circuit to provide a delay equivalent to the black insert period with respect to a vertical synchronizing signal, as the frame synchronizing signal, for achieving synchronization in a frame vertical direction; and an SR flip-flop to receive, as input triggers, the vertical synchronizing signal and an output signal of the delay circuit, wherein the black insert control section is arranged to output an output signal of the SR flip-flop as the black insert signal.

3. The LED driver of claim 2, wherein the black insert control section comprises a logical operation circuit that, according to an enable signal for controlling whether or not to permit black insert, directly passes the output signal of the SR flip-flop when the black insert is permitted, and when the black insert is inhibited, masks the output signal of the SR flip-flop.

4. The LED driver of claim 1, further comprising a current control section to generates a voltage signal whose voltage level varies according to a current-amount control signal for setting an amount of the drive current, and to supply the voltage signal as the reference voltage to each of the current sources as the reference voltage.

5. The LED driver of claim 4, wherein the current control section sets, according to an enable signal for controlling whether or not to permit black insert, the voltage level of the voltage signal such that the amount of the drive current when the black insert is permitted is larger than the amount of the drive current when the black insert is inhibited.

6. A display device comprising:

a display panel;

LEDs to illuminate the display panel; and the LED driver of any one of claim 1 or 2 through 5 to perform on-off control of the LED.

* * * * *